US009719267B2

(12) United States Patent
Rogers

(10) Patent No.: US 9,719,267 B2
(45) Date of Patent: Aug. 1, 2017

(54) HIGH CAPACITY VERTICAL MEMBER FOR USE WITH MODULAR SCAFFOLDING

(71) Applicant: Peter J. Rogers, Toronto (CA)

(72) Inventor: Peter J. Rogers, Toronto (CA)

(73) Assignee: Athos Construction Products Inc., Marietta, GA (US)

( * ) Notice: Subject to any disclaimer, the term of this patent is extended or adjusted under 35 U.S.C. 154(b) by 0 days.

(21) Appl. No.: 14/504,005

(22) Filed: Oct. 1, 2014

(65) Prior Publication Data

US 2015/0014096 A1 Jan. 15, 2015

Related U.S. Application Data

(63) Continuation of application No. 13/418,192, filed on Mar. 12, 2012, now abandoned, which is a continuation-in-part of application No. 12/230,522, filed on Aug. 29, 2008, now Pat. No. 8,136,633.

(30) Foreign Application Priority Data

Jun. 10, 2008 (CA) ..... 2634573

(51) Int. Cl.

| | |
|---|---|
| ***E04G 7/32*** | (2006.01) |
| ***E04G 7/30*** | (2006.01) |
| ***E04G 1/06*** | (2006.01) |
| ***E04G 5/10*** | (2006.01) |
| ***E04G 1/14*** | (2006.01) |

(52) U.S. Cl.

CPC ..... *E04G 7/301* (2013.01); *E04G 1/06* (2013.01); *E04G 1/14* (2013.01); *E04G 5/10* (2013.01); *E04G 7/32* (2013.01)

(58) Field of Classification Search

CPC ..... E04G 7/301; E04G 7/32

See application file for complete search history.

(56) References Cited

U.S. PATENT DOCUMENTS 2,771,324 A * 11/1956 Ryder ..... E04G 1/06 52/637
3,506,090 A * 4/1970 Beziat ..... E04G 1/00 182/178.6
3,902,817 A * 9/1975 Meir ..... E04G 7/16 182/178.5

(Continued)

FOREIGN PATENT DOCUMENTS

CA 2205154 A1 * 11/1998 ..... E04G 5/02
DE 2134170 A1 * 1/1973 ..... E04G 7/301

(Continued)

*Primary Examiner* — Alvin Chin-Shue

(57) ABSTRACT

A vertical member of a modular scaffolding system includes a securing rosette provided in an upper section having a reduced diameter to provide a pre-determined modular connection. The vertical member includes an elongate intermediate section forming the majority of the vertical member of a first diameter greater than the reduced diameter. The intermediate section at a lower edge includes an integral spigot of the reduced diameter. A reinforcing sleeve is fixedly secured to the upper section above the rosette and forms a spigot receiving socket. The vertical member has higher capacity due to the larger diameter intermediate section while maintaining modularity of the scaffolding system.

12 Claims, 18 Drawing Sheets

(56) References Cited

U.S. PATENT DOCUMENTS

| | | | | | |
|---|---|---|---|---|---|
| 4,004,393 | A * | 1/1977 | Morris | E04G 7/305 | 182/179.1 |
| 4,015,395 | A * | 4/1977 | Gostling | E04G 7/22 | 182/186.7 |
| 4,586,844 | A * | 5/1986 | Hammonds | E04G 7/20 | 182/178.3 |
| 4,587,786 | A * | 5/1986 | Woods | E04G 7/307 | 182/186.8 |
| 5,367,852 | A * | 11/1994 | Masuda | E04G 1/06 | 182/186.7 |
| 6,161,359 | A * | 12/2000 | Ono | E04G 11/48 | 14/75 |

FOREIGN PATENT DOCUMENTS

| | | | | |
|---|---|---|---|---|
| DE | 2334050 | B1 * | 3/1974 | E04G 1/12 |
| FR | 2527280 | A1 * | 11/1983 | E04G 7/301 |
| FR | 2908143 | A1 * | 5/2008 | E04G 1/06 |

* cited by examiner

HIGH CAPACITY VERTICAL MEMBER FOR USE WITH MODULAR SCAFFOLDING

RELATED APPLICATIONS

This is a continuation of U.S. application Ser. No. 13/418,192 filed Mar. 12, 2012 entitled "High Capacity Vertical Member for Use with Modular Scaffolding"; which is a continuation-in-part of U.S. Pat. No. 8,136,633 filed Aug. 28, 2008 entitled "Modular Scaffold System," both of which are incorporated herein by reference.

FIELD OF THE INVENTION

The present application related to a high capacity vertical member compatible with modular scaffolding and the high capacity vertical members in combination as part of a modular scaffold system.

BACKGROUND OF THE INVENTION

Scaffolding systems can be generally divided into three major types of systems, namely tube and clamp systems, frame and cross-brace systems, and modular systems. The tube and clamp systems are extensively used in the industrial sector and are easily adapted to cope with confined spaces where there are many obstructions such as pipes, stairways, structural steel frameworks, etc. These systems require considerable expertise to erect correctly, and are almost always erected by experienced professional scaffold erectors. With the more recent adoption of modular systems, the tube and clamp systems are now primarily used only for infill areas that cannot be effectively serviced by the modular systems.

Frame and cross-brace systems are very common and these systems are typically used by painters, bricklayers, masons and many other trades to provide effective elevated work platforms. These systems may be used in industrial applications for low rise applications or for other specific uses where guardrails and tie-off rules are less stringent. The frame and cross-brace systems are less rigid as there is some pivotal movement of the frames due to tolerances with respect to the cross-braces. In many jurisdictions, the safety authorities reject the use of cross-braces as effective guardrails and often tubular or wooden guardrails are required in addition to the cross-braces. In order to restrict the weight of the frames, which are typically five feet wide and six feet in height, the tubes used in the frames have an outer diameter of approximately 1.69 inches. In contrast, the support posts of the tube and clamp systems are typically of a diameter of approximately 1.90 inches and of a higher load carrying capacity.

Modular systems have also been used for high load applications. These systems are made of pre-engineered components of specific lengths. The components have integral connection devices that allow connection between the different components of the system, and the system is easily erected in different configurations. These types of systems are commonly used in industrial applications such as refineries and power stations. In North America, the support posts of these systems are typically 1.90 inches in diameter. Frames are typically not used in this type of modular system in that frames made of 1.90 inch diameter tube and of a typical width of approximately 5 feet, are too heavy to be easily carried by a worker. As previously, indicated, frame-type systems are typically of smaller diameter tube to keep the weight as low as possible. Typically, the above-described systems are not inter-compatible.

As labour costs continue to rise, there is a preference for scaffolding systems that are easy to erect. In this way the contractors, that are operating on small margins, are able to erect the system quickly and at reduced cost. The frame and cross-brace type systems are fast to erect and easy to use, and do not require the expertise necessary for tube and clamp and modular systems. The use of frame-type systems can result in a labour saving in the order of 35%.

The present invention utilizes a modular scaffold system that advantageously provides inter-compatibility between a support post-type system and a frame-type modular scaffolding system. This inter-compatibility allows for effective use and labour saving where frames can be suitably used while also providing the higher load capabilities of a support post-type modular system where required. The inter-compatibility of the systems allows the various connecting components such as ledgers and cross-braces to be of the same length while maintaining modularity of the system.

It is also desirable to provide a higher capacity vertical member compatible with many existing modular scaffold systems. Preferably this high capacity vertical member includes a simplified securement.

SUMMARY OF THE INVENTION

A vertical member of a modular scaffolding system according to the present invention comprises an extruded tube having a long intermediate section of a first diameter and integral top and bottom tubular sections of reduced diameter. The top tubular section has a securing rosette fixedly secured to the tubular top section adjacent a transition between the first diameter of the intermediate section and the reduced diameter tubular top section to define limited load bearing surfaces of said tubular top section either side of said rosette. The tubular top section above the rosette includes an outer tubular reinforcing sleeve extending beyond and having an overlapping relationship with said tubular top section. The tubular reinforcing sleeve has an inside diameter larger than the reduced diameter to form a top opening socket tube. The bottom tubular section extends downwardly and forms a spigot sized for receipt in a top opening socket tube of a further vertical member of the modular scaffolding system.

In an aspect of the invention, the tubular reinforcing sleeve is spaced upwardly of the rosette to define a short limited length of said reduced diameter top section sufficient to tightly accommodate insertion and connection of ledger heads to said rosette without interference with the top opening socket tube while the top opening socket tube cooperates with and reinforces the top section to improve the load carrying capacity of the vertical member.

In an aspect of the invention, the socket tube at a free end thereof includes a locking collar having locking slots located outwardly of the diameter of said socket tube and the spigot includes at least one outwardly projecting locking member receivable in one of the locking slots.

In yet a further aspect of the invention, the top tubular section cooperates with the reinforcing sleeve whereby an end of said top tubular section forms a spigot stop face for said top opening socket tube.

According to an aspect of the invention, the locking collar includes a first and second locking slot and a first and second receiving slot in the locking collar and locking projections of the spigot are receivable in the locking slots.

In a further aspect of the invention, the locking collar is non-pivotally secured to the spigot.

In yet a further aspect of the invention, the locking collar is integrally connected to the spigot tube.

In a preferred aspect of the invention, the locking collar includes four receiving gaps and four locking slots providing a series of orientations in which an upper scaffold leg may be inserted on and connected to the locking collar.

DETAILED DESCRIPTION OF THE PREFERRED EMBODIMENTS

As indicated in the background of the invention, scaffolding systems, particularly for industrial applications, require substantial load-carrying capabilities, and as such, support posts are often used where the outer diameter of the support posts is approximately 1.90 inches. These support posts are easily carried by a single worker, and the support posts typically have a number of connection points at pre-determined positions intermediate the length of the support post. These support posts are inter-connected by ledgers such as ledgers 10 and these types of systems also include diagonal brace-type members of the appropriate length. With such a post system, the modular spacing between posts is effectively fixed by the connecting components.

Figure 1:
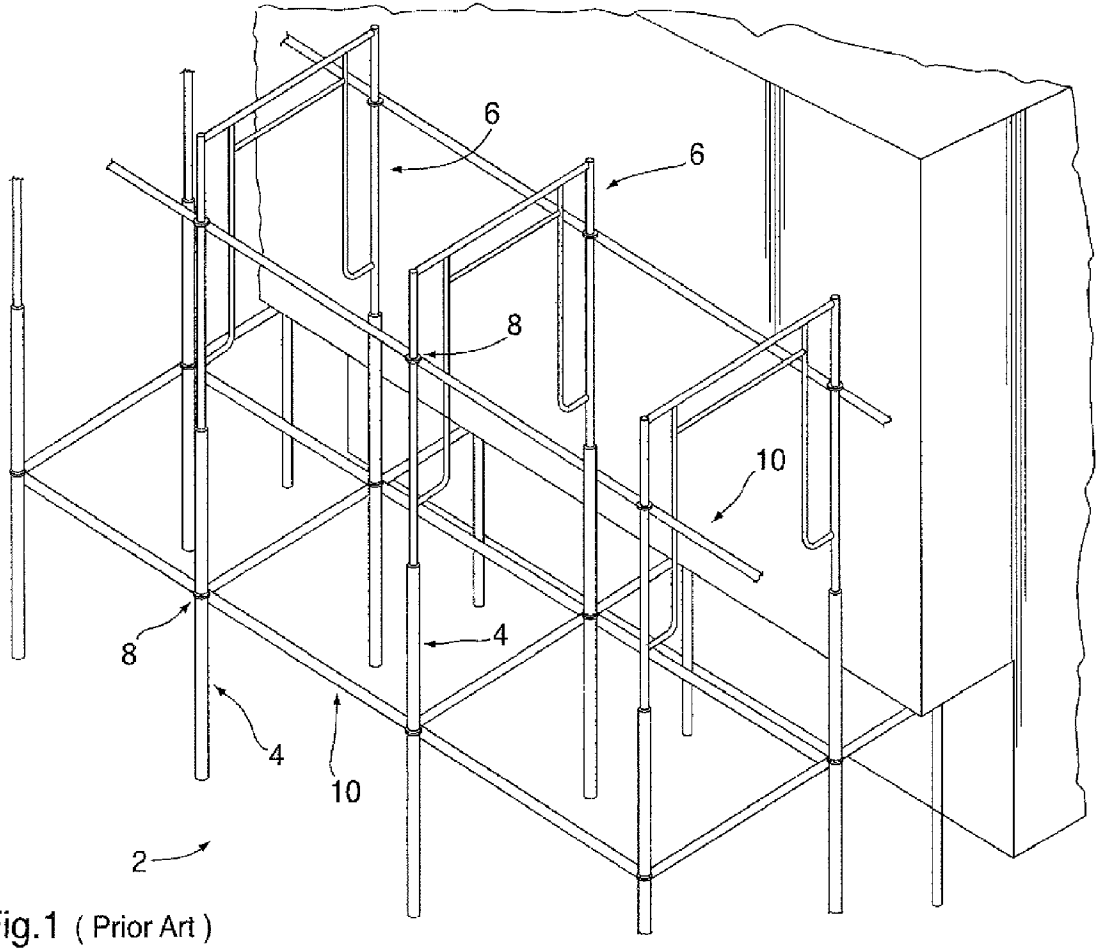
Fig.1 ( Prior Art )
FIG. 1 is a partial perspective view of a support post scaffolding system in combination with a modular frame system.
Figure 2:
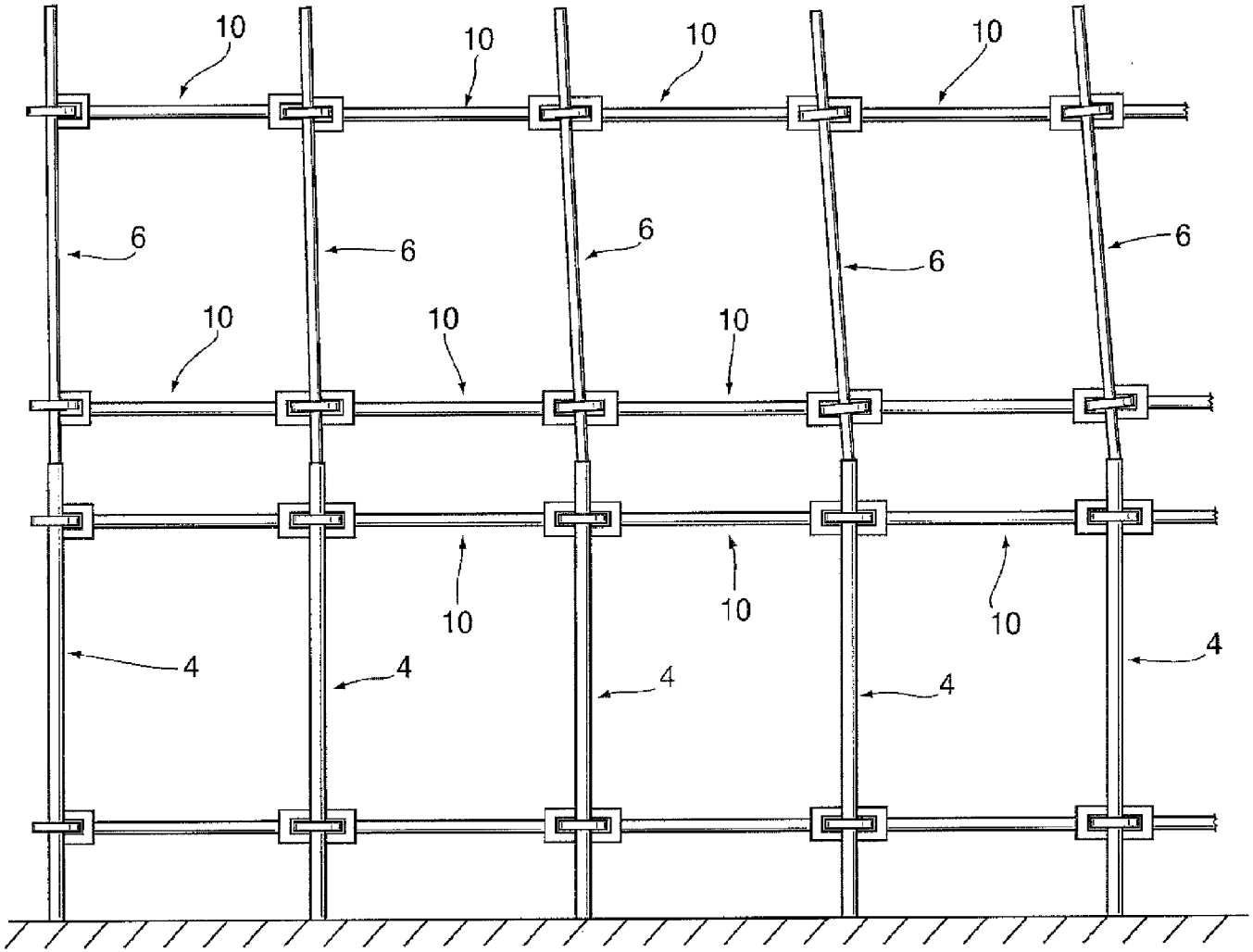
Fig.2 ( Prior Art )
FIG. 2 is an elevational view of a support post system with a modular frame system positioned thereabove and the problems associated with the cumulative effect of off-modularity of the two systems.

As shown in FIG. 1, frame systems such as frames 6 can also be connected in a similar manner to the connection between the scaffold posts indicated as 4. If the same connecting components used for the scaffold post system are used in the frame system, the modularity of the frame system is determined by these connecting components. This creates a problem in that the uprights of each frame system are of a reduced diameter, typically 1.69 inches, which is necessary to maintain the frame at a weight that is easily carried by the workers. As shown in the elevational view of FIG. 2 the initial change in the modularity on the left side of the Figure is not that great, however the change in modularity continues to accumulate, and as shown with the frame 6 at the right side of the Figure, it has now been placed at a substantial angle and the load-carrying capability thereof is greatly reduced. It is certainly possible to develop a scaffold support post system having uprights of the same size as the frames 6, however the industry generally wants the higher load-carrying capability of the larger-diameter support posts. The industry also prefers to use the modular systems where less expensive labour can be used to erect the system, and as such, a standardization of the connecting components such as the ledgers and cross-braces has resulted in the non-integration of such systems.

Figure 3:
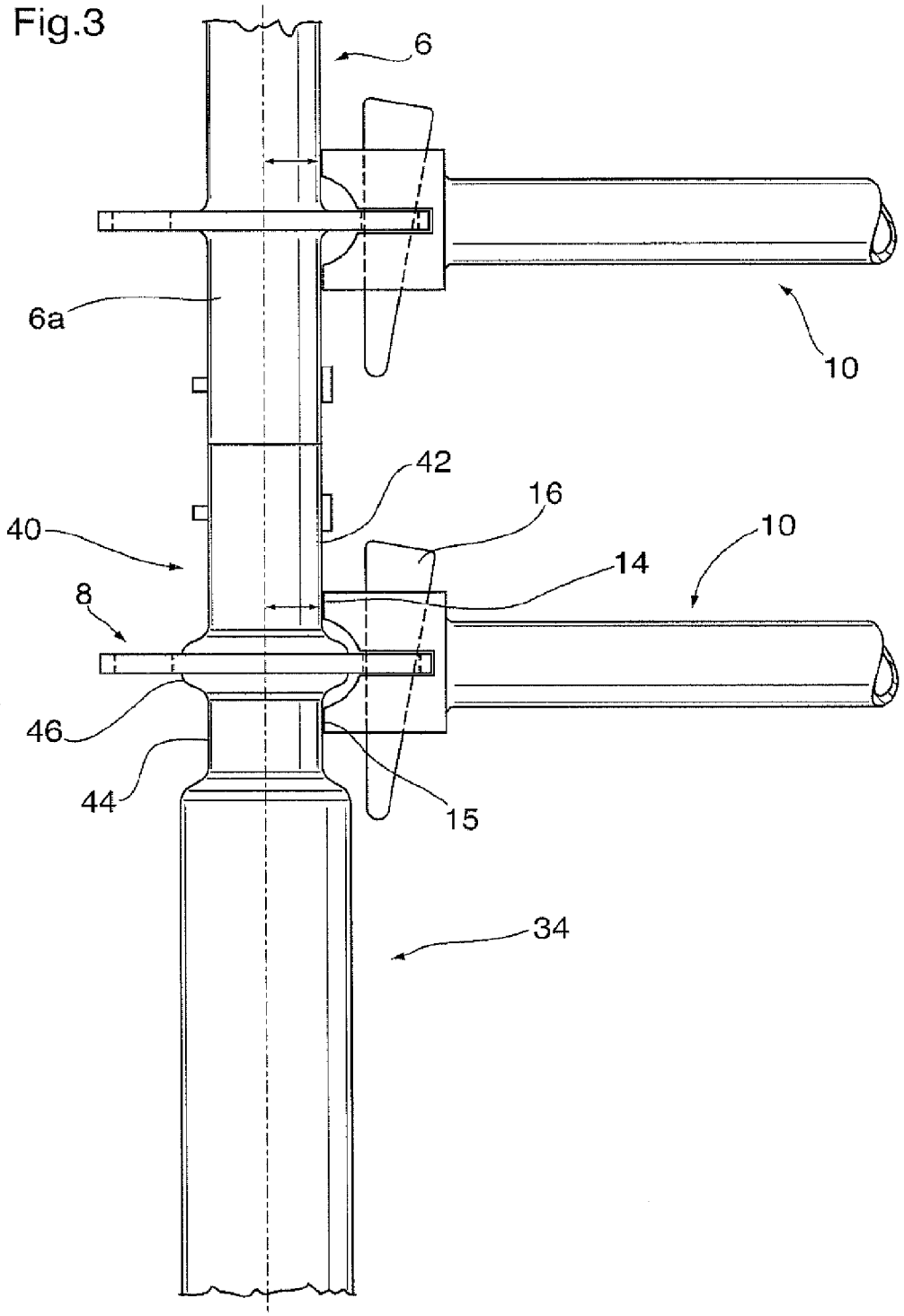
FIG. 3 is a partial vertical view of a modified scaffold support post in combination with a modular frame system where common ledgers are used between these systems.
Figure 4:
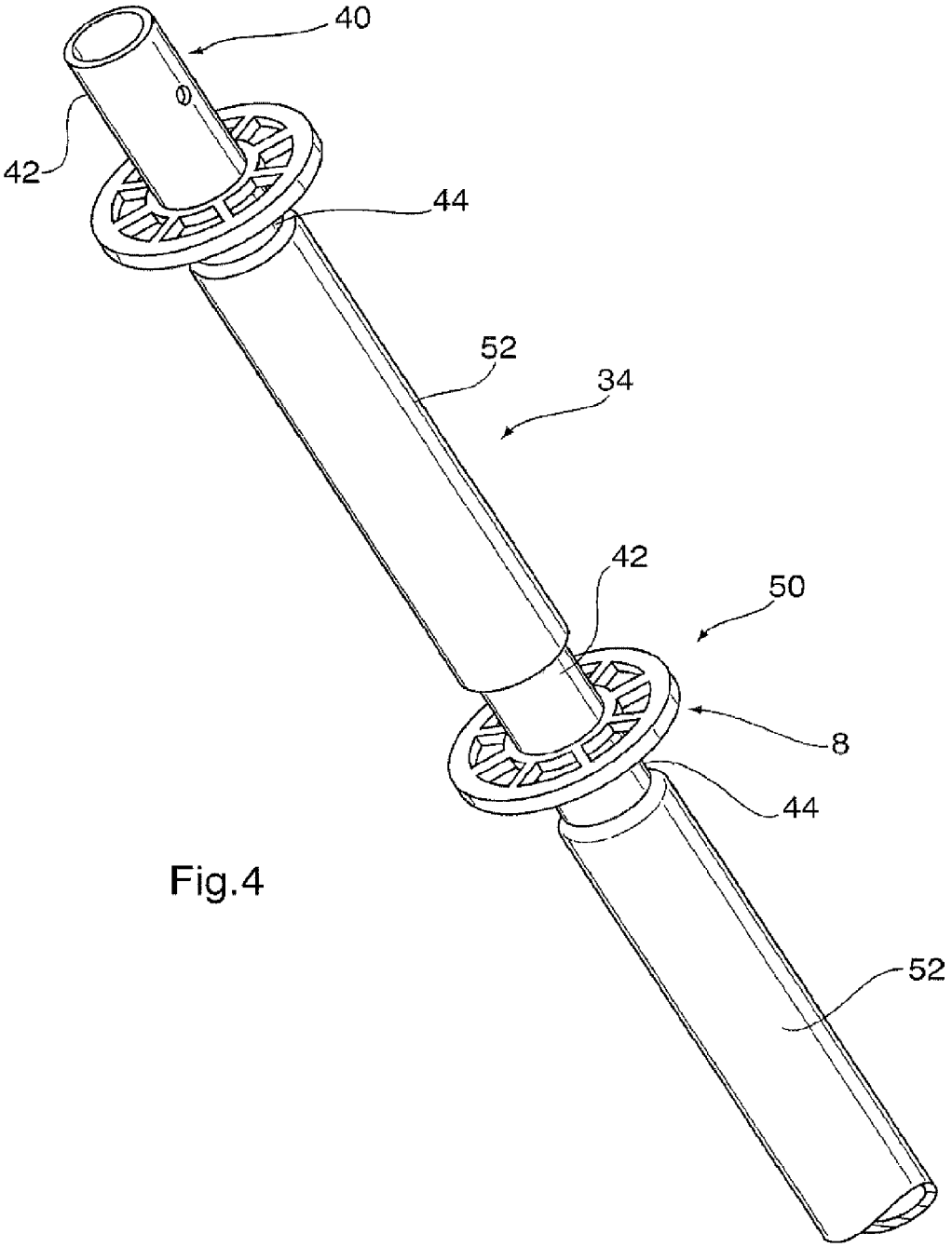
FIG. 4 is a partial perspective view of a modified scaffold support post.

The modified scaffold support post 34 shown in FIG. 3 has been designed to effectively overcome the difficulties described above and the problems indicated in FIGS. 1 and 2. In this case, the support posts 34 are of the larger diameter 1.90 inches (48 mm), but include at the connection points, areas of reduced diameter to effectively match with the reduced diameter of the frame uprights, namely the diameter of approximately 1.69 inches (42 mm). The connecting component, such as the ledger 10 as shown in FIG. 3, is thus able to maintain the identical modularity between support posts 34 and the frames 10. This modularity is maintained in that the connection is always based on the smaller diameter upright. Although the ledger 10 is shown, any cross-bracing and other specialized components will also be fully integrated into the system as the modular spacing is now common between the frame and the support posts.

In order to manufacture the support post 34 in a cost-effective manner, the support post is made of an elongate tube 34 of the larger diameter that is effectively reduced at the connection points to the smaller diameter size. This reduction to the smaller diameter size is preferably formed by swaging of the larger diameter tube. Some reduction in the load-carrying capacity of the tube does occur, however this reduction is tolerable in that the modularity of the system is maintained. The cost advantages of erecting an effective work platform using frames where appropriate, more than offsets the additional cost or small reduction in load carrying capability of the support posts. The system allows the support posts to be used where their higher capacity is required or where the particular structure demands the use of support posts.

The modified support post 34 as shown in FIGS. 3, 4, 5 and 6, includes an end portion 40 of reduced diameter to correspond typically with the size of the upright 6*a* of the frame. In these Figures, the end portion 40 includes an upper reduction 42 separated from the lower reduction 44 by the securing ring 46 of the original larger diameter. This securing ring 46 is sized to receive the rosette 8 and typically the rosette 8 is welded to this securing ring. With this arrangement the port in the rosette would be sized for the larger diameter of the tube and secured on the securing ring. This type of connection is particularly advantageous for the intermediate connecting points generally in the middle portions of the support post. The rosette can be sleeved over the larger diameter of the support tube and then positioned on a securing ring of a reduced connecting portion. For example, in a six foot support post there are rosettes at the top and bottom of the support post and these portions would be of reduced diameter. Typically there would be two intermediate rosettes and these would be located on the reduced connecting portions at the securing rings.

A preferred spacing between the two intermediate rosettes is approximately 500 mm. The reduced connecting portions are sized (i.e. of a length) to accommodate the ledger heads and are preferably less than 100 mm. In one preferred design the total reduced length including the rosette attachment portion is approximately 80 to 85 mm. It is desirable to keep this reduced area as short as possible while still allowing ease of securement and release of the ledger heads. The actual length of the reduced area is a function of the ledger head, the rosette and ease of assembly.

The swaged area at the top and bottom of the support post is preferably approximately 150 mm and would include the area where the rosette is attached.

Figure 5:
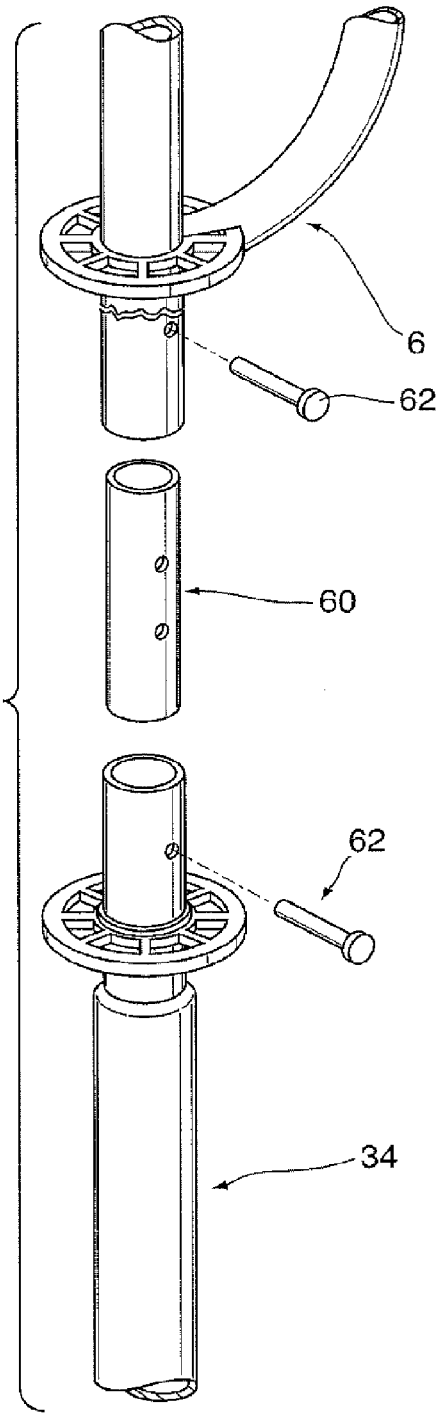
FIG. 5 is a partial perspective view showing the modified scaffold support post and a bottom portion of a scaffold frame.
Figure 6:
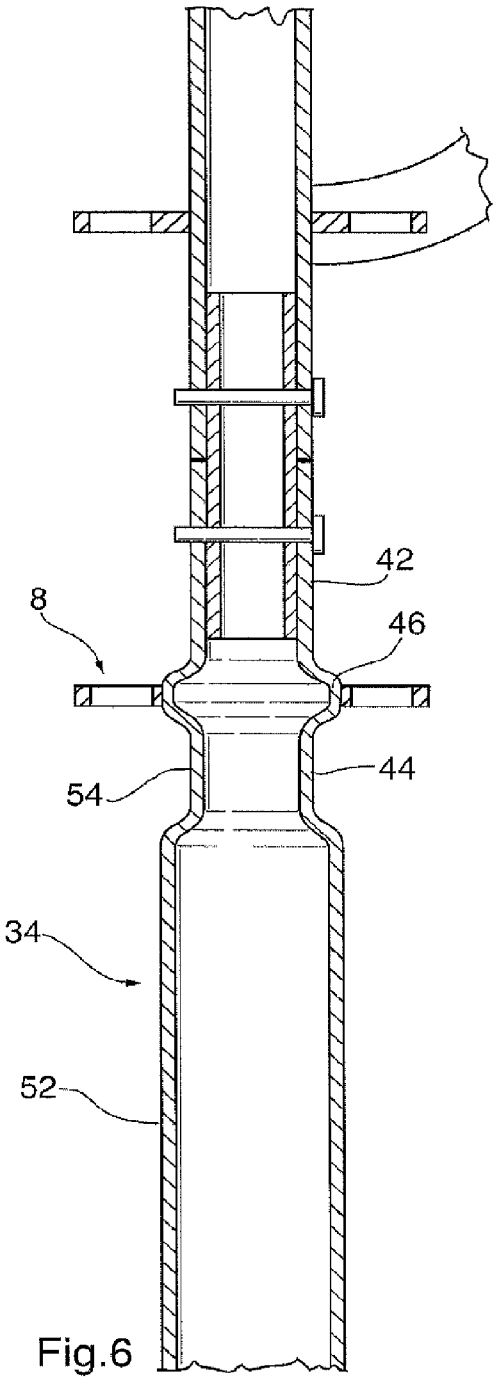
FIG. 6 is a cross-sectional view showing the connection of the modified scaffold post and modular scaffold frame of FIG. 5.

As best shown in FIG. 3, the ledger 10 used to connect the frames and the ledger 10 used to connect support posts, are all based on the smaller diameter sections and as such modularity is maintained. Thus support posts can be connected to horizontally adjacent support frames and support posts can easily be replaced by support frames. Frames can be stacked above support posts without changing any of the modularity of the system. The particular connections of the support posts to the frames as shown in FIGS. 5 and 6 illustrate the reduced end portion 40 that receives the connecting spigot 60 that is inserted in the end portion 40 and is held in position due to the locking pin 62. Similarly, the spigot 60 is locked to the frame by the upper locking pin 62. This is merely one example of the mechanical connection that is possible between the support posts and the scaffold frames. Other arrangements are clearly possible. It is preferable that the ends of the support posts are of the reduced diameter but it is not essential.

With the present invention, the scaffold support post includes at its ends and at intermediate portions along its length areas of reduced diameter sized and adapted to provide modular connecting points. These modular connecting points are designed to be compatible with the smaller diameter uprights of the support frames. With this arrangement, support posts can be effectively manufactured using the standard larger diameter tubes such as 1.90 inches in diameter, and these tubes can be swaged at appropriate points to provide the necessary reduction in diameter. The face to face connection of the ledgers 10 i.e. the upper and lower abutting faces 14 and 15 of the ledgers on these reduced portions, is the same as would be achieved with respect to the ledger head connecting to the upright of the scaffold frame. Thus the connections are common between the two components of the system and the advantages with respect to labour are maintained.

The system of support posts with an initial diameter of approximately 48 mm and swaged areas of reduced diameter having a searing rosette or other connection structure has been described for use with a scaffold frame system where the tube size is the common 42.9 mm diameter.

As described above reducing the support posts at the swaged areas to a 42.9 mm outside diameter reduces the load carrying capability of the support posts. This reduction in load carrying capability is a trade off to allow modularity with the common scaffold frame size in North America.

It is also possible to have the support posts swaged to be compatible with frames that use a 45 mm×2.2 mm tube. In this case the 48 mm support posts have a series of swaged areas of 45 mm diameter and the support posts will have a higher load carrying capability.

In addition coupling pins, used to vertically stack frames or connect support posts to the vertical tube of a frame, can be simplified as each end of the coupling pin can be of the same diameter approximately 1.5 inches.

Clamps for tube size of 45 mm are also commonly available, however clamps for the smaller size tube of 42.9 mm are generally not compatible.

The use of the 45 mm tube for the scaffold frame system in combination with the 48.9 mm support post with 45 mm reduced swaged areas provides higher load carrying capability for the combined system, as well as higher load carrying capability of the frame system. Some increase in the weight of the frame has occurred due to the larger size tube.

Figure 17:
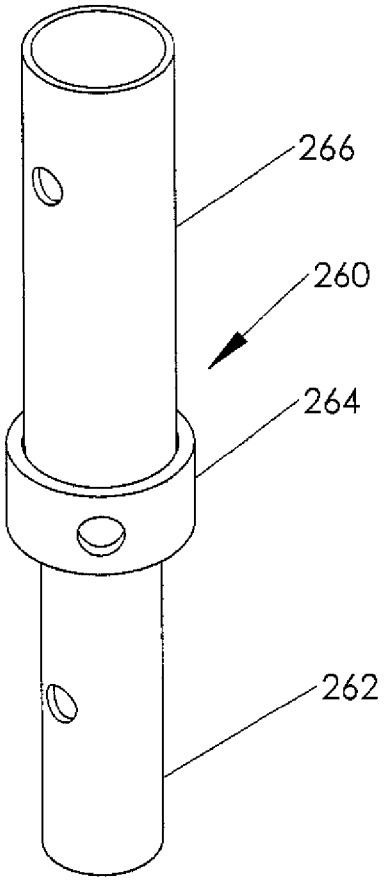
FIG. 17 is a perspective view of a first coupling pin.

An example of a coupling pin for the 48.9 mm support post and 45 mm scaffold frame is shown as 250 in FIG. 17.

Figure 18:
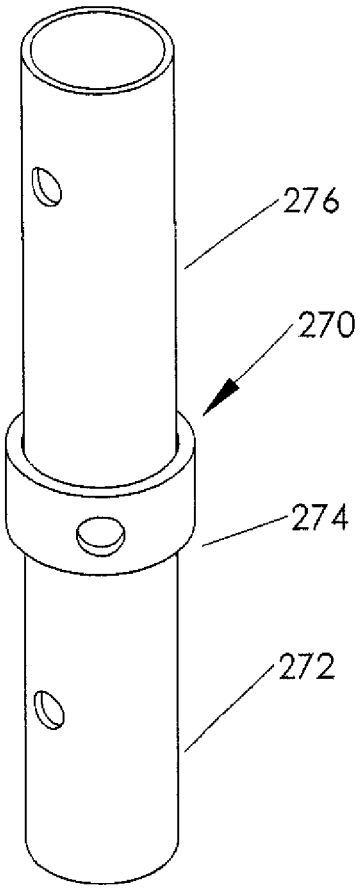
FIG. 18 is a perspective view of a second coupling pin having different diameters on opposite sides of the collar.

An example of a coupling pin 260 for a 48.9 mm support post and a 42.9 mm tube of a scaffold frame is shown in FIG. 18. The support post would receive a 1.5 inch tube portion and the frame tube portion is of reduced diameter. This arrangement allows a snug fit but is a specialized coupling pin that is required for a support post to frame connection. The tube of the pin can be reduced by swaging to provide a continuous connecting member through the collar 270.

With the above system, there are many applications where the design of the scaffold for carrying out a particular job can advantageously use the support posts where required and the frames where required. With this system the higher load-carrying capability of support posts can be used where required and the labour advantage associated with the use of support frames are easily achieved where frames are more suitable. The system allows for effective overall design to meet any particular needs.

With this system the support posts at the connection points require a reduced area to appropriately abut with connecting components used in frame systems. The actual stack connection of a post to frame or frame to post is preferable to use the same size end segment to match a frame to frame connection but specialized adapters could be used.

Figure 7:
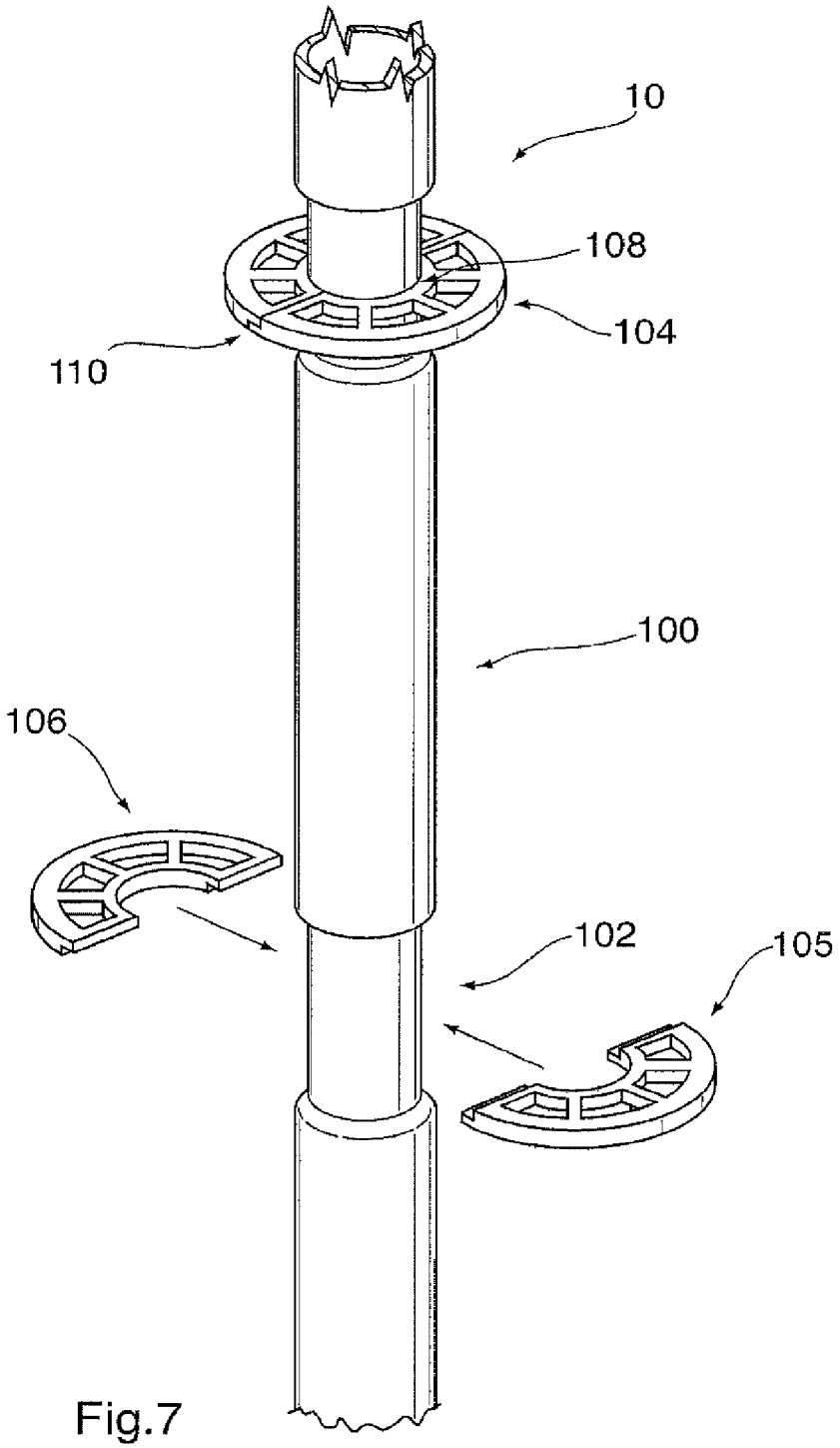
FIG. 7 is a partial perspective view of a modified scaffold support post.

The modified scaffold support post 100 shown in FIG. 7 includes one example of a two-piece rosette 104 that is welded to reduced areas 102 of the support post. In this case, the reduced areas 102 are of a generally constant diameter and are typically formed by swaging of the support post. The two-piece rosette 104 includes sections 105 and 106 that are actually the same component but merely reversed in orientation. Each of the components 105 and 106 has part of an interior port that abuts with the diameter of the reduced section. The rosette is welded at 108 to the reduced section. Typically, the split rosette will also be welded at the split line 110.

With the two piece rosette 104 of FIG. 7, there is no requirement to provide a larger securing band area on the reduced section as shown in the earlier Figures.

It can be appreciated that there are other alternatives for forming of a two-piece type rosette which is welded and secured to the reduced sections.

Figure 8:
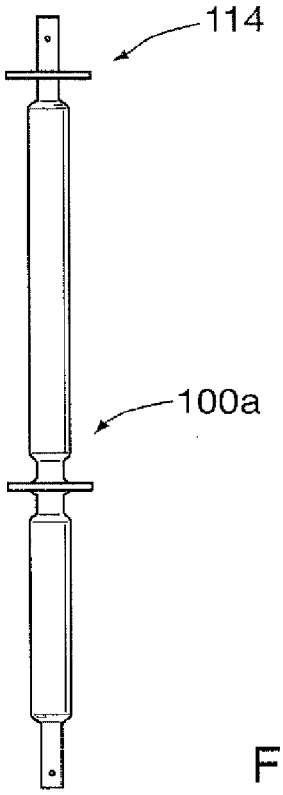
FIGS. 8, 9 and 10 are elevational views of scaffold support posts of different sizes.
Figure 9:
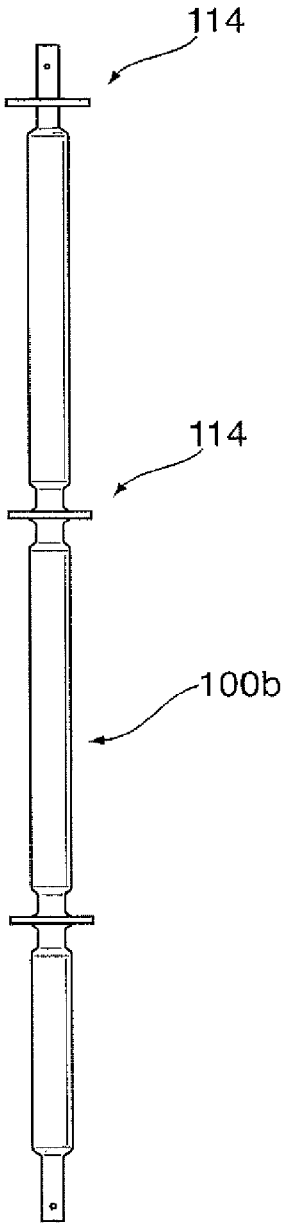
Figure 10:
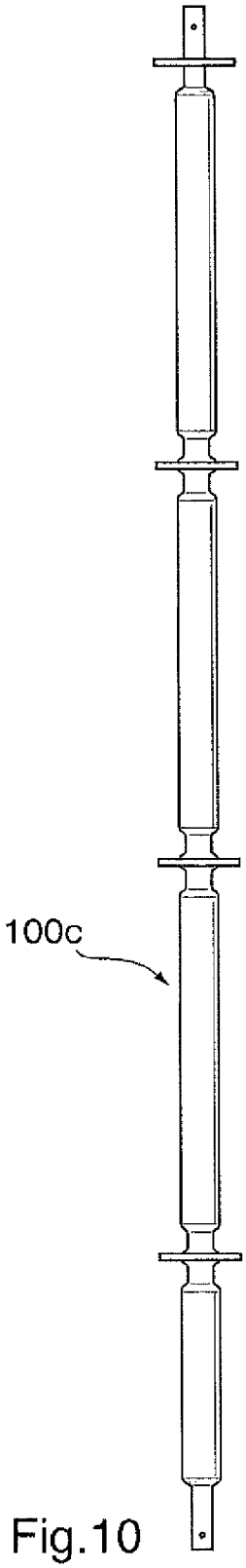

FIGS. 8, 9 and 10 show examples of different scaffold support posts 100*a*, 100*b* and 100*c* that are of different modular heights. Each of these support posts include connecting rosettes 114 at predetermined positions in the length of the support posts.

Figure 11:
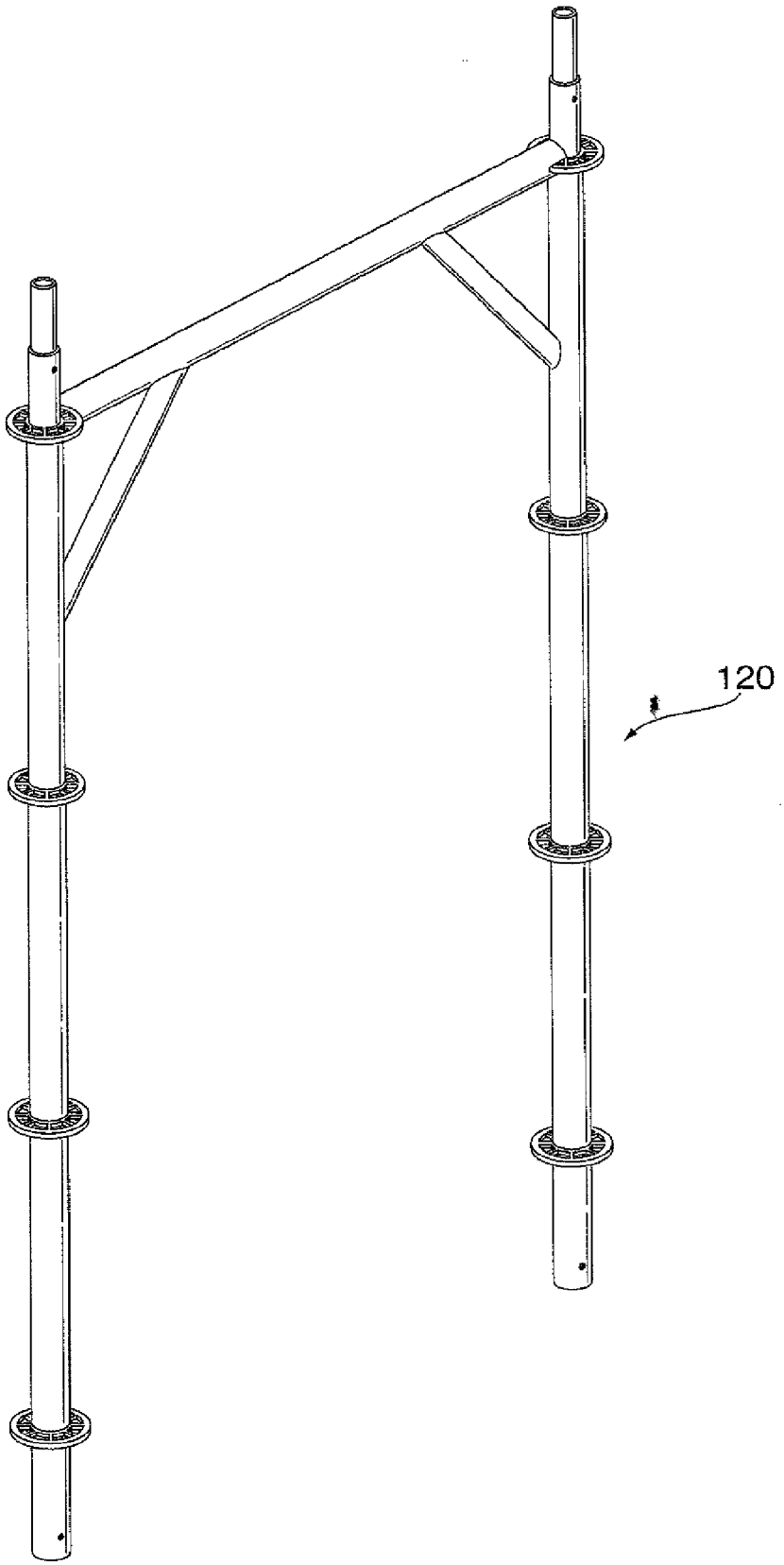
FIGS. 11 and 12 are perspective views of two different walk-through frames.
Figure 12:
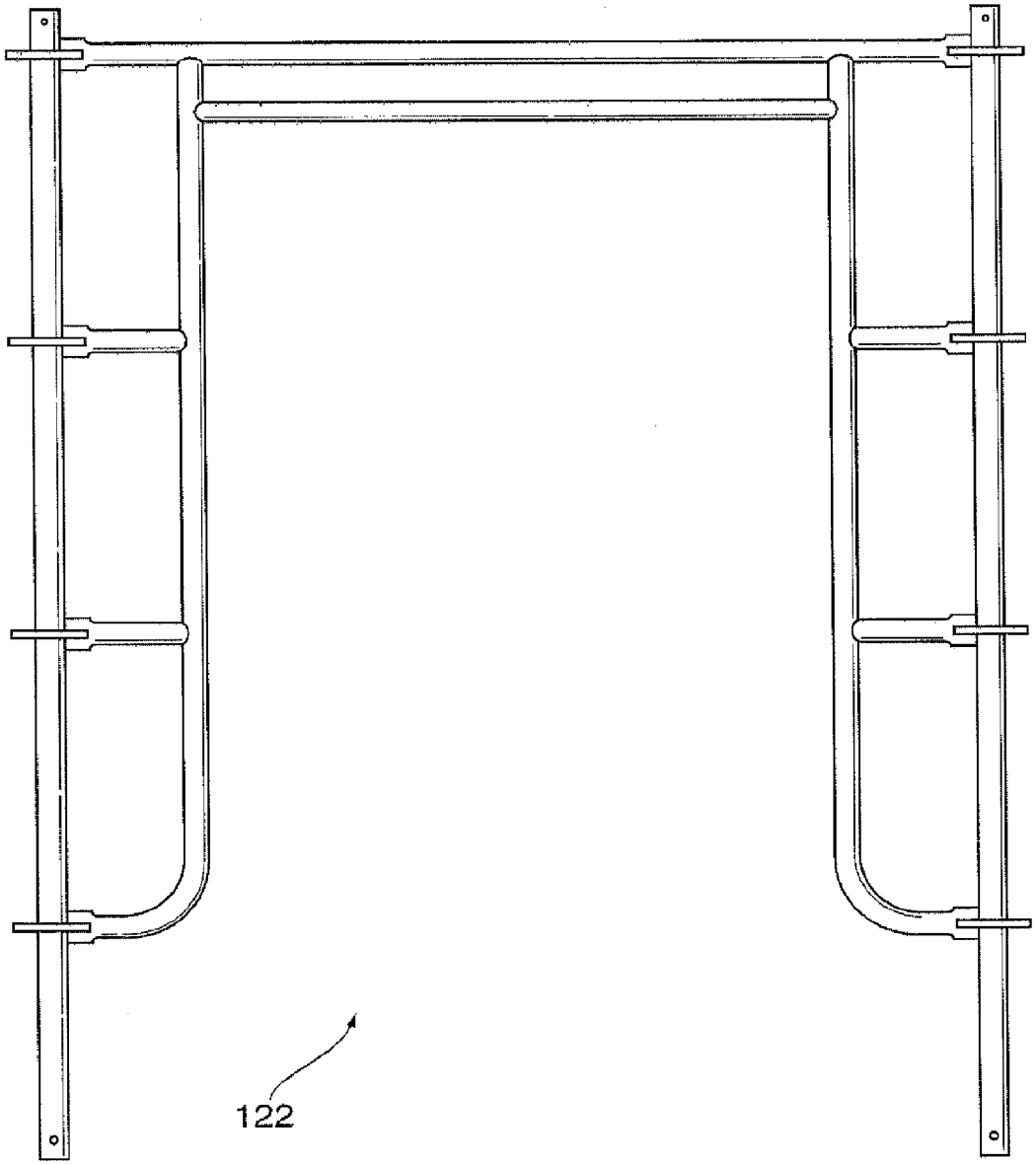
Figure 13:
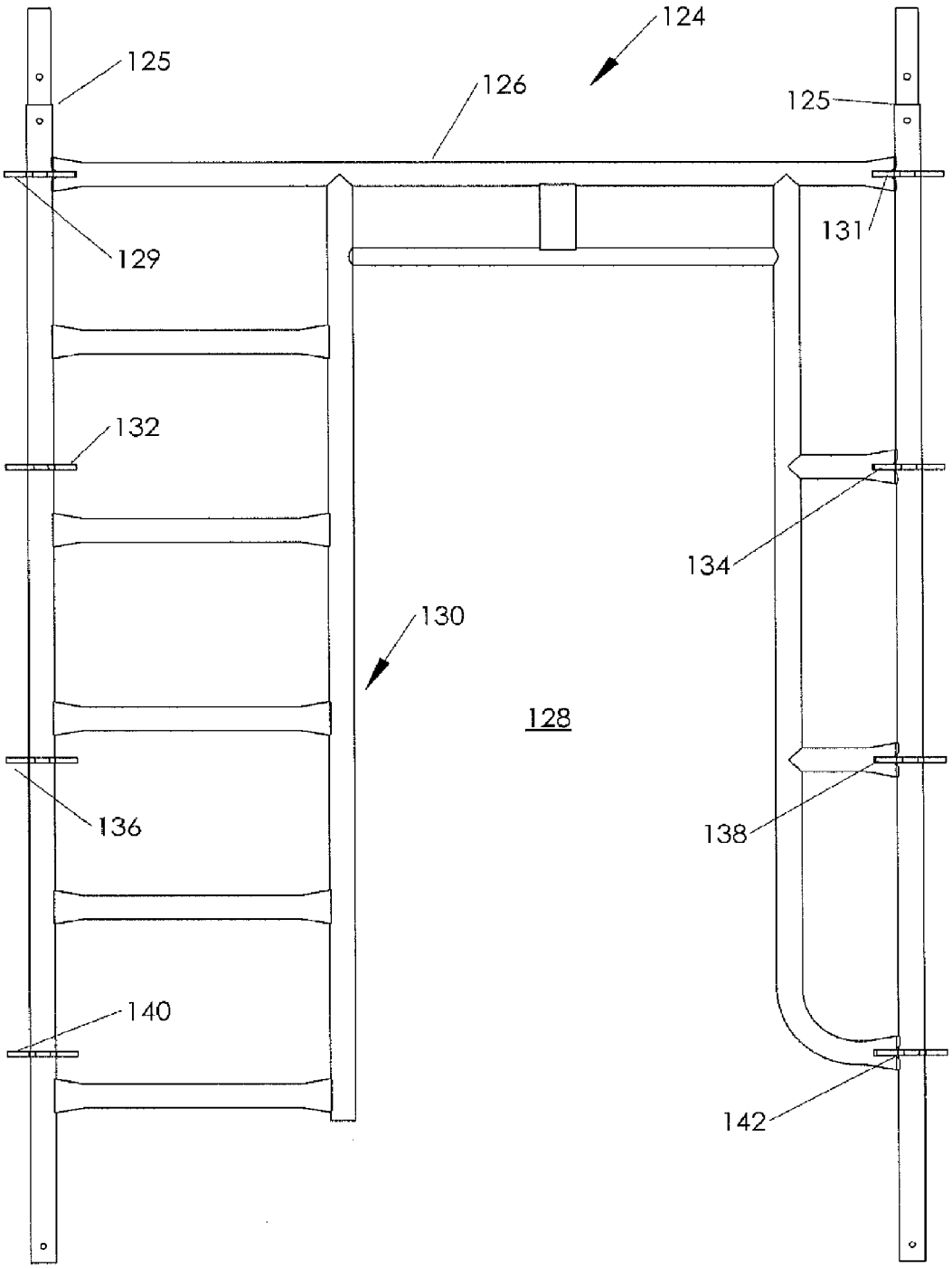
FIG. 13 is an elevational view of a walk-through access frame.

The integrated scaffolding system of the present invention uses the scaffold support posts in combination with scaffolding frames such as the walk-through frame 120 or the walk-through frame 122 of FIGS. 11 and 12. Each of these frames include connecting rosettes 114 at the appropriate modular spacing for effectively connecting with the rosettes of the scaffold support posts. Different types of scaffolding frames will all include the connecting rosettes 114 at the appropriate placements on the upright components. For example, the scaffolding frames could be any of the accepted walk-through type frames of FIGS. 11 and 12, mason frames, ladder frames or plasterer's frames, as are well known in the industry. Each of the uprights of these different types of frames will include an appropriate number and placement of the connecting rosettes 114. With this arrangement, the scaffolding frames with the rosettes can effectively connect with the scaffolding posts, and the scaffolding frames can also be used in their normal application. The typical connections provided on these known frames can be maintained and the rosettes are merely added. In this way, there may be applications where the traditional connection of the frames is preferred.

FIGS. 13 through 16 are examples of other frames that have been adapted to include the connecting rosettes and to also coordinate these connecting rosettes with horizontal structural members of the frames. The walk-through frame 124 of FIG. 13, when in use, has an overall height of approximately 2 meters, and the spigots at the top portions of the uprights extend above this height. The upper connecting rosettes are positioned preferably at 110 mm from the connecting edge 125 and the upper horizontal connecting component 126 is aligned with the upper rosettes. The frame includes the clear area 128 for walking through the frame and a ladder portion 130 provided in the left hand side. Each of the intermediate connecting rosettes 132, 134, 136 and 138 are positioned preferably at 500 mm from the centre line of the adjacent upper rosette. The bottom rosettes 140 and 142 are positioned preferably 500 mm from the next intermediate rosettes and at 390 mm from the base of the frame. The bottom rosettes (140, 142) when the frame is stacked on a similar frame or support post, will be spaced from the top rosette of the component below by 500 mm (390 mm plus 110 mm of the component below).

At the ladder portion 130 rosettes 132, 136 and 140 may have the portion of the rosette that extends into the ladder portion, (i.e. into the frame) removed to avoid the possibility of tripping during use of the ladder. Preferably the rosettes are positioned and cooperate with horizontal adjacent components of the frame.

Figure 14:
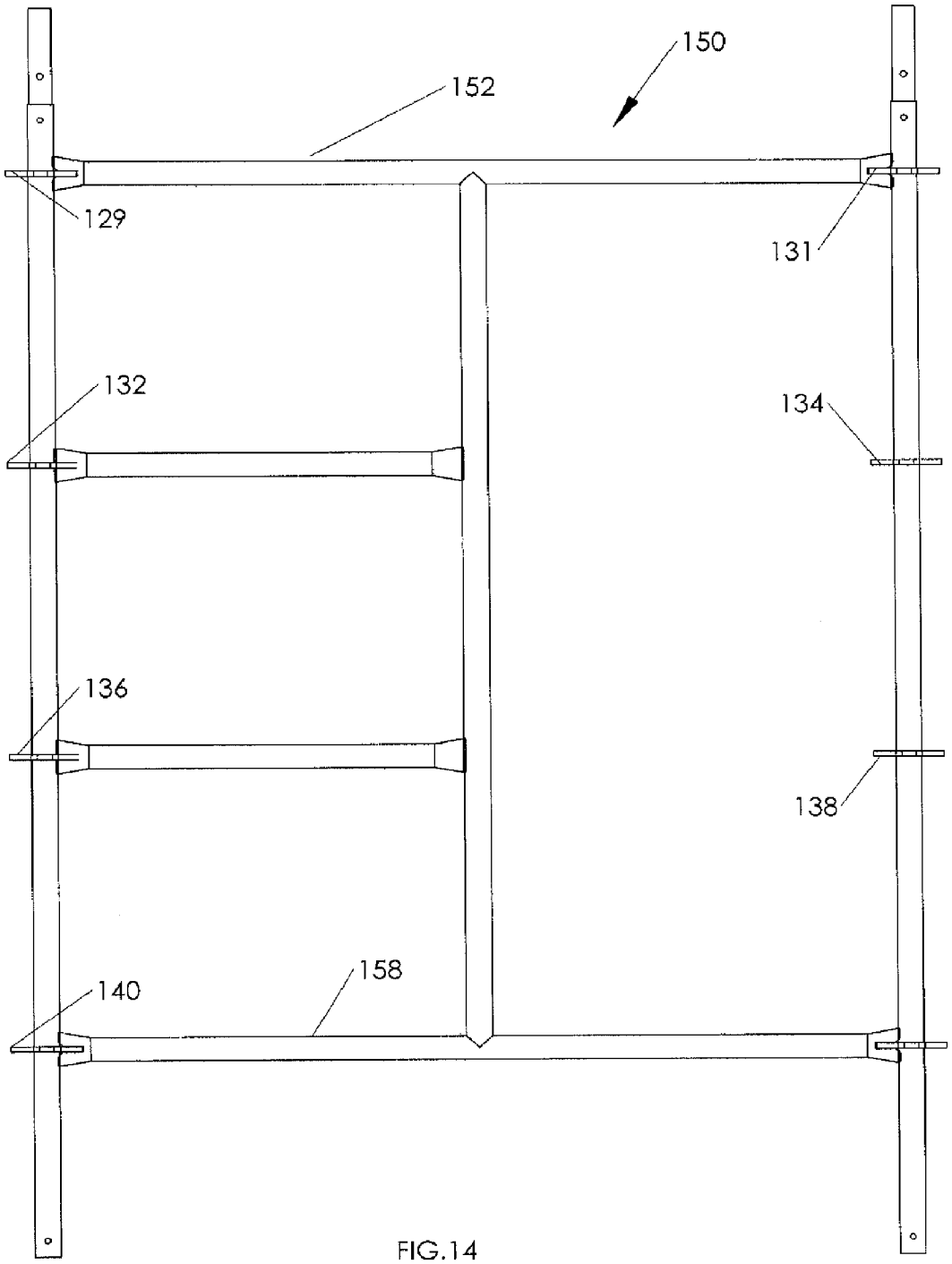
FIG. 14 is an elevational view of a mason frame.

In FIG. 14 a mason frame 150 is shown and the upper rosettes 129 and 131 are again positioned to align with the upper horizontal member 152. Rosettes 132, 136 and 138, provided at the left hand side of the frame are all at the same spacing as horizontal members 154, 156 and 158, and are aligned with and connected at the respective rosettes.

Figure 15:
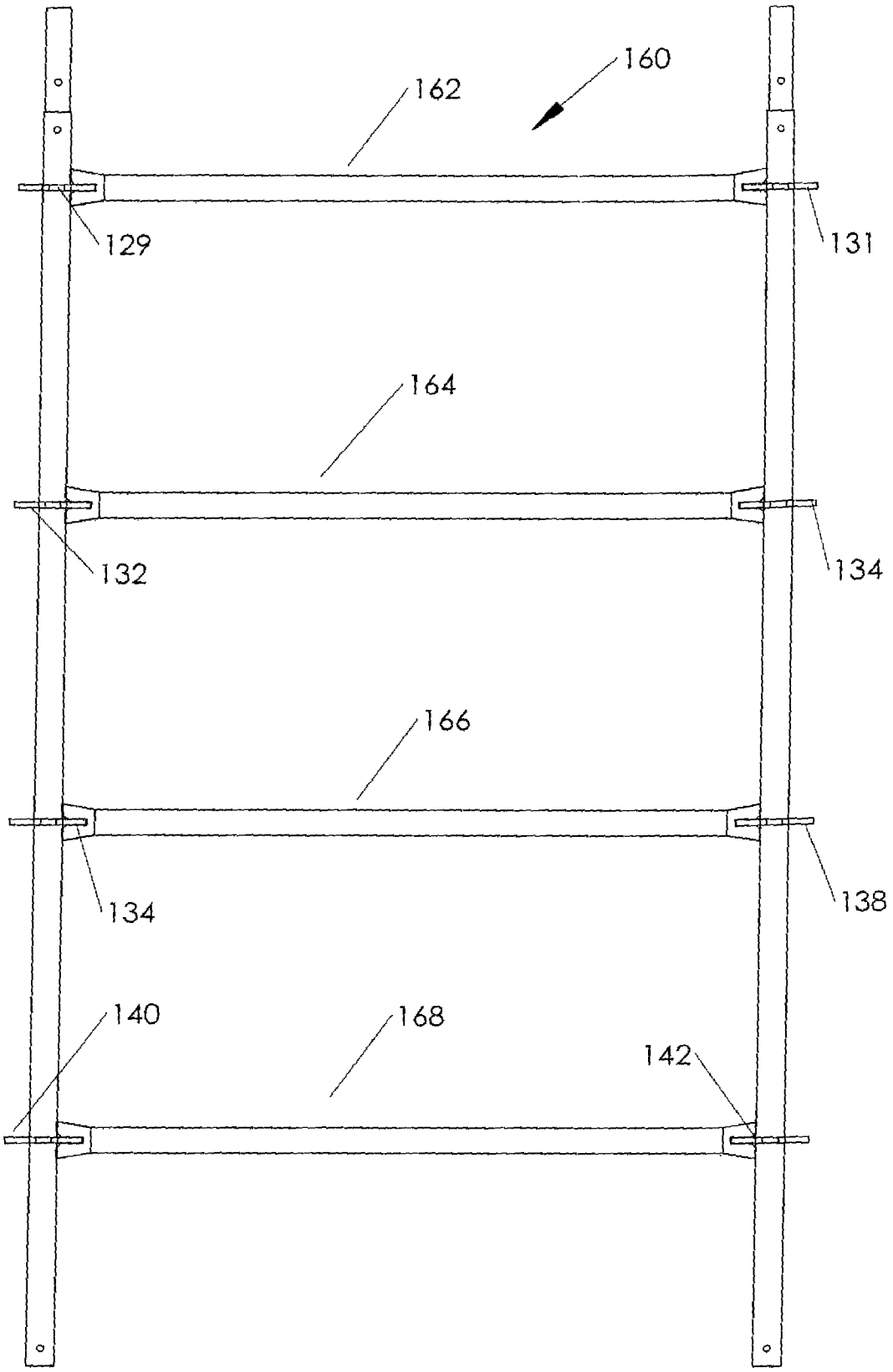
FIG. 15 is an elevational view of an end frame.

An end frame 160 is shown in FIG. 15 and includes 4 horizontal members 162, 164, 166 and 168 that are each aligned with a pair of the connecting rosettes. For example, horizontal member 162 is aligned with connecting rosettes 129 and 131.

Figure 16:
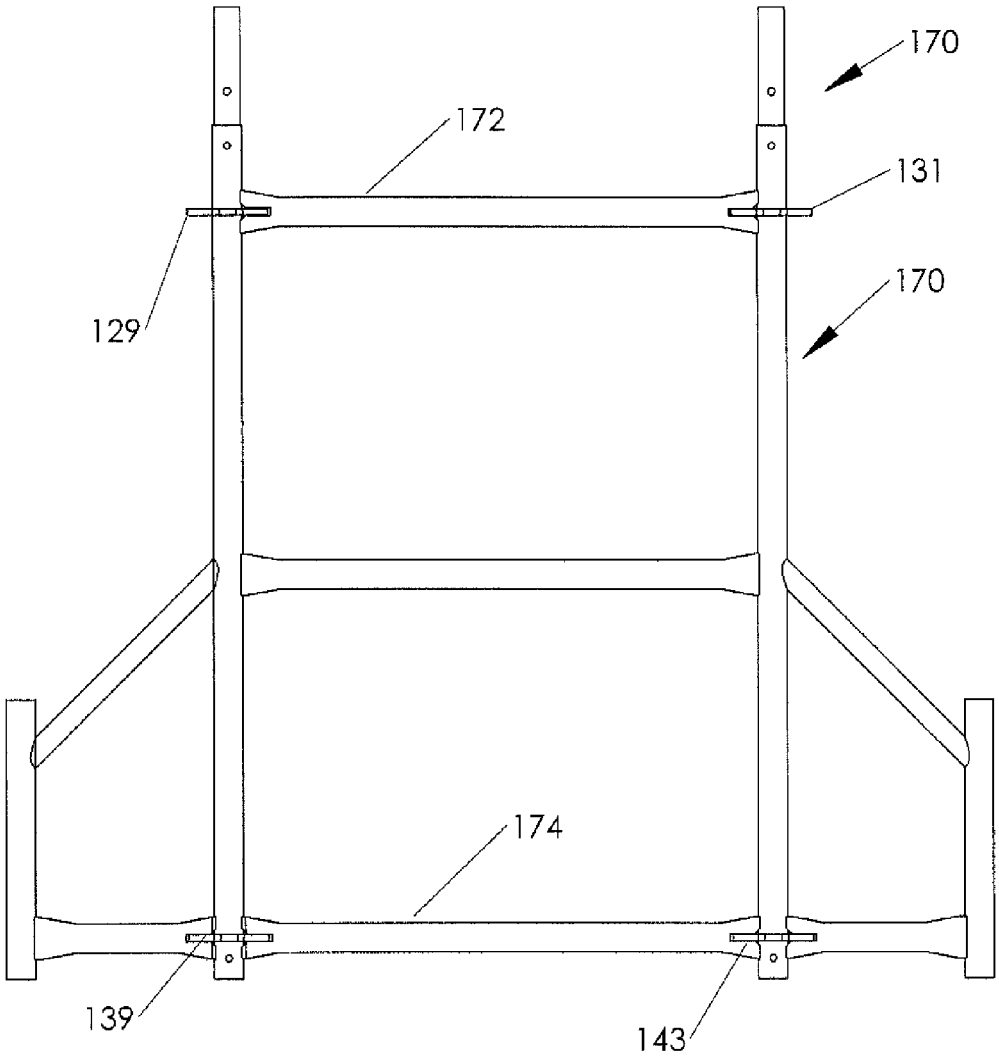
FIG. 16 is an elevational view of a base frame for a two-foot wide ladder frame.

In FIG. 16 a base frame 170 for two-foot wide ladder frames is shown. In this frame, upper rosettes 129 and 131 are positioned adjacent the horizontal member 172 and bottom rosettes 139 and 143 are provided adjacent the base of the frame and generally aligned with the horizontal member 174. Connecting rosettes 129 and 139 are vertically spaced by approximately 1000 mm. With the base frame 170, smaller two-foot ladder frames will be stacked above this frame.

Scaffolding frames are of various designs for specific applications. As part of the present scaffolding system using scaffolding support posts and scaffolding frames, any of these specialized frames can be used by appropriately placing connecting rosettes on the upright members of the frames. These frames can be modified to position horizontal members generally at the connecting rosettes, or the connecting rosettes can be adapted to not extend into the interior space of the frame if this may present a safety hazard, for example. The portion of the connecting rosette extending into the frame is not used, as the frame effectively forms this connection. It can be readily appreciated that any of the known scaffolding frames can be adapted to include the connecting rosettes appropriately spaced to be used as part of the present modular scaffolding system.

It is desirable in a modular scaffolding system to provide the ability to support higher loads such as those that may be encountered in concrete construction such as supporting of forms for forming concrete forms and providing support for the concrete floors during the curing of the concrete. It may also be advantageous to use such higher capacity for temporary shoring of buildings that are undergoing renovation.

This ability to use the existing connection and modular grid system of existing scaffolding systems is advantageous as it allows the owners of the scaffolding systems to easily address scaffolding access needs and higher capacity support needs.

As can be appreciated, higher capacity systems such as modular shoring systems are known however such modular systems are not freely interchangeable with existing scaffolding systems. The vertical tubes of commonly used vertical members of modular scaffolding systems are generally of a diameter of about 48.3 mm. In order to provide a higher load carrying capability it is desirable to use vertical tubes of a diameter of about 60 mm.

Figure 19:
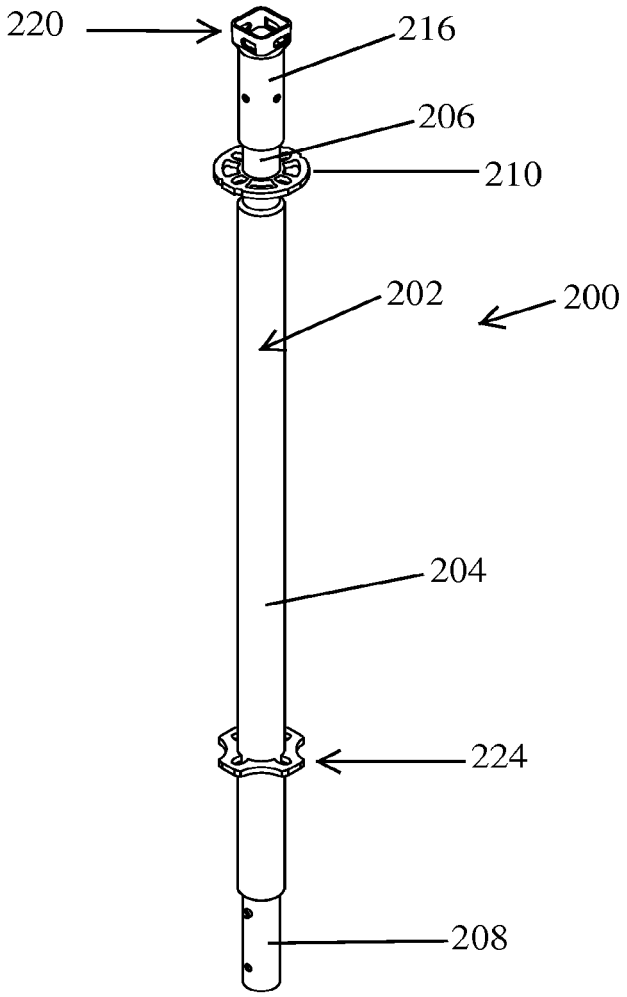
FIG. 19 is a perspective view of a further high capacity vertical member compatible with many modular scaffolding systems.

The improved high capacity vertical member of a modular scaffolding system is shown in FIG. 19. The high capacity vertical member 200 includes an extruded tube 202 having a long extended intermediate section 204 of a first diameter and a short top tubular section 206 and short bottom tubular section 208 of a reduced diameter. Sections 204, 206 and 208 are integral and various arrangements for providing the reduced diameter of the top and bottom tubular sections can be used such as swaging or seaming.

With the high capacity vertical member 200 a securing rosette 210 is provided on the top tubular section 206 and provides either side of the rosette a limited ledger head receiving portion that engages the reduced diameter of the tubular section. The tubular reinforcing sleeve 216 limits the area for the ledger heads and also reinforces the top tubular section. Additional details of the cooperation of the tubular reinforcing sleeve and the top tubular section will be provided in a discussion of FIGS. 20 through 24.

The tubular reinforcing sleeve 216 preferably includes a locking collar 220 at the end of the high capacity vertical member 200. As can be seen from FIG. 9 the high capacity vertical member 200 includes the securing rosette 210 at the upper portion of the vertical member and does not include securing rosettes of this type in the intermediate section 204. A large securing member 204 is attached to the intermediate section 204 adjacent a lower portion of the vertical member however this is of a larger diameter for engaging the larger diameter of the intermediate section.

In the high capacity vertical member 200 as shown in FIGS. 19 through 25, there is only one securing rosette on each vertical member. The vertical members are available in a series of modular lengths, for example, 1000 mm, 1500 mm and 2000 mm such that when they are joined in an end-to-end connection the vertical spacing of the rosette connections would also be at 1000 mm, 1500 mm or 2000 mm. This is advantageous in that most modular scaffolding systems have rosette connections spaced at 500 mm spacing. This allows for using vertical members of the appropriate length to provide connections on multiples of 500 mm and at desired points. As will be more fully discussed, the vertical member due to the reduced diameter at the securing rosette maintains a pre-determined spacing of the rosettes vertically and also allows for the spacing between vertical members of the shoring system to be maintained. Furthermore, the reduced diameter top and bottom end sections allow use of existing screw jacks to be used top and bottom of the system. These screw jacks typically have an outside diameter of approximately 38 mm and thus are receivable in the inside diameter of the reduced portion of the present vertical post which is approximately 42 mm. The advantage of the present system can be appreciated from the various views shown in FIGS. 20 through 22.

Figure 20:
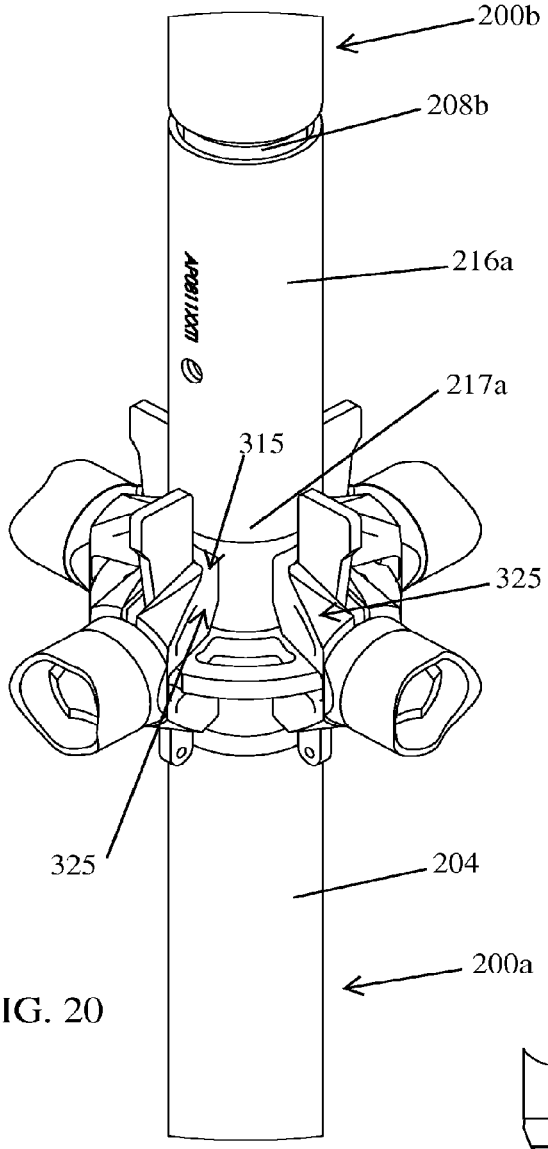
FIG. 20 is a partial perspective view of two connected high capacity vertical members and connection with horizontal bracing members.
Figure 22:
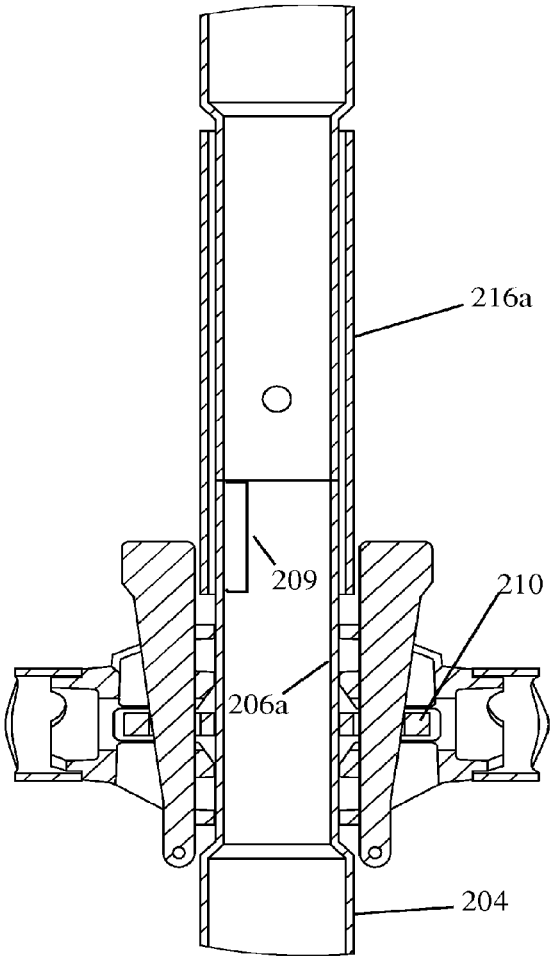
FIG. 22 is a partial sectional view of the two connected high capacity vertical members taken along Section B-B of FIG. 21.
Figure 21:
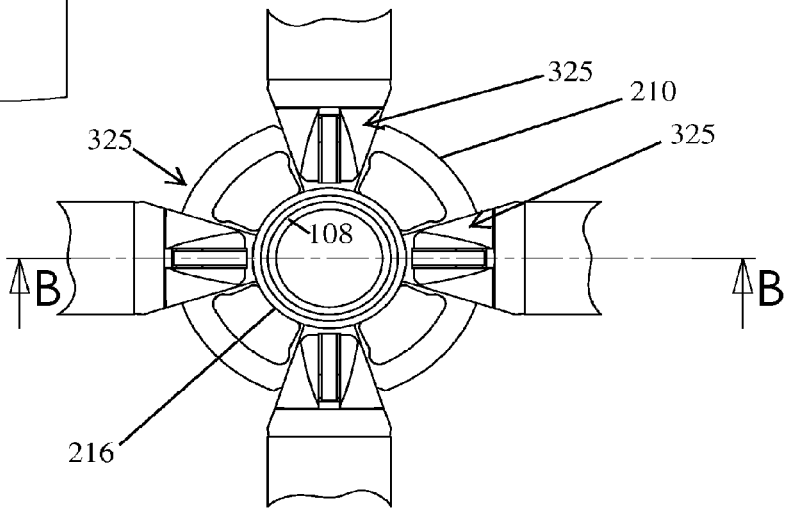
FIG. 21 is a top view of the connections of FIG. 20.

FIG. 20 shows a lower high capacity vertical member 200*a* vertically connected to an upper high capacity vertical member 200*b*. As can be seen the bottom tubular section 208*b* of the upper vertical member 200*b* is received in the tubular reinforcing sleeve 216*a* of the lower vertical member 200*a*. It can also been seen that the lower edge 217*a* of the reinforcing sleeve 216*a* is closely adjacent the upper edge 315 of the ledger heads 325. The ledger heads as shown in the sectional view of FIG. 22 engage the reduced diameter top tubular section 206*a*. This reduced tubular section 206*a* is an area of reduced strength however this area has been minimized in length and has been reinforced by the reinforcing sleeve 216*a*. It can be seen that there is a substantial overlap between the reinforcing sleeve 216*a* and the upper edge 209 of the reduced tubular section 206. The bottom tubular section is received within the reinforcing sleeve 216*a* and bottoms out on the top portion 209 of the tubular section 206. As can be appreciated there is also a limited vertical extent of the top tubular section 206 below the securing rosette 210 and this vertical extent is preferably only sized for easily receiving the ledger heads. Providing this reduced diameter section with the securing rosette adjacent the top end of the vertical member and providing the appropriate reinforcing as discussed above does not significantly reduce the load carrying capacity that would be provided by the larger diameter of the intermediate section 204.

Figure 25:
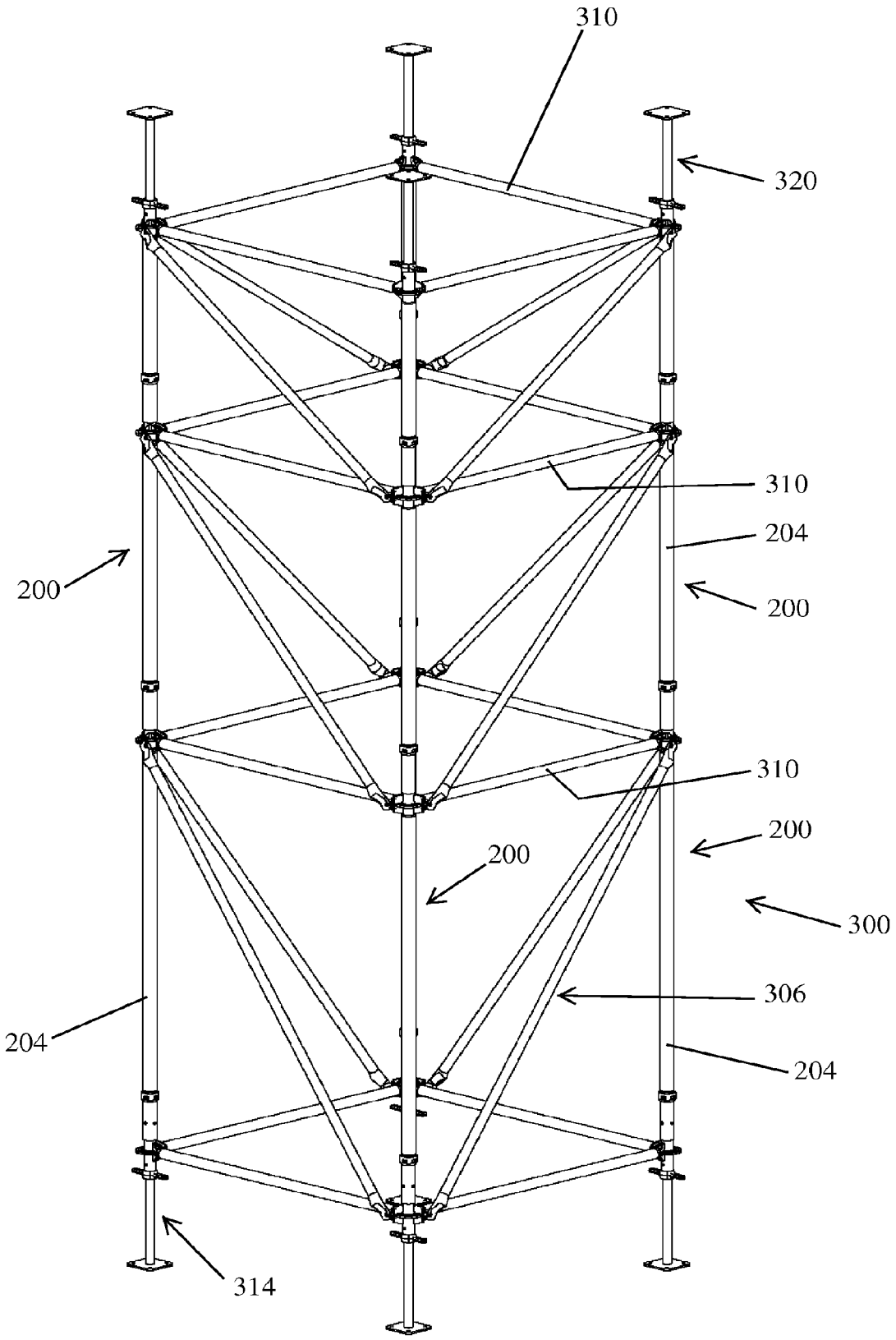
FIG. 25 is a perspective view of connected high capacity vertical members forming a support tower.

FIG. 25 shows a support tower 300. The support tower includes a series of vertically connected vertical members 200, a series of horizontal braces 310 and diagonal braces 306. The lower edge of the tower includes screw jack type feet 314 and similar screw type jacks 320 are provided at the top of the tower. This tower due to the larger diameter of the intermediate section 204 of the vertical members has higher capacity and can be used for supporting of concrete forming applications and other applications requiring additional capacity. The fact that the securing rosettes are provided on a top tubular section of reduced diameter allows these vertical members to maintain the modular grid spacing of a scaffolding system designed on a reduced diameter. For example, the top tubular section 206 would have a diameter of 48.3 mm which is the outer diameter of the tubes of many modular scaffolding systems. The intermediate section would have a diameter of 60.3 mm. This is the same diameter as the reinforcing sleeve 216. This tube size typically has an inside diameter of 53.9 mm. The top tubular section is reduced to 48.3 mm and similarly the bottom tubular section that forms the spigot is reduced to 48.3 mm.

Figure 24:
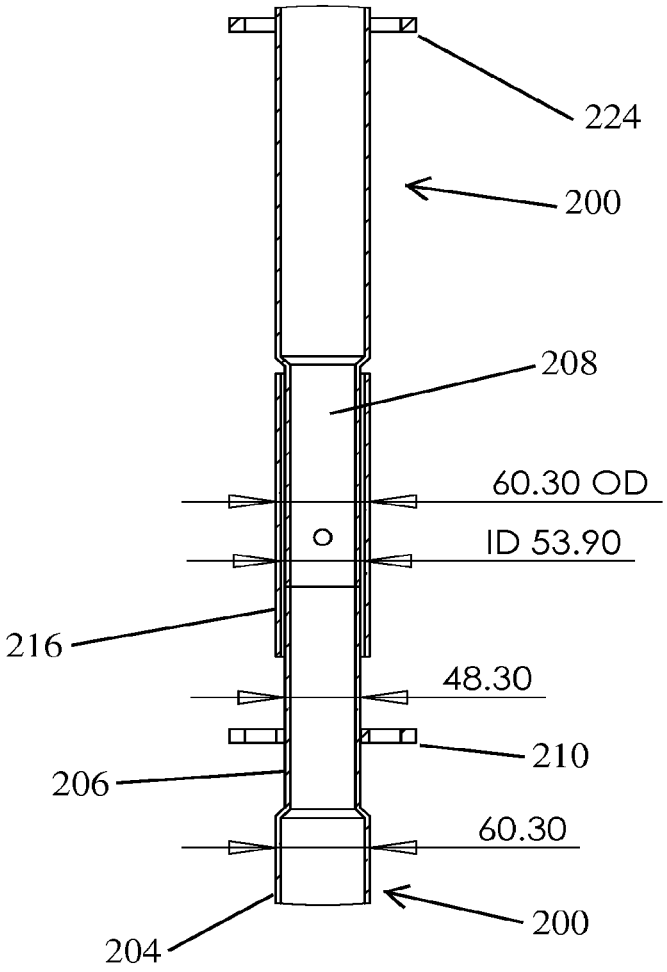
FIG. 24 is a sectional view showing an enlargement of area B of FIG. 23.
Figure 23:
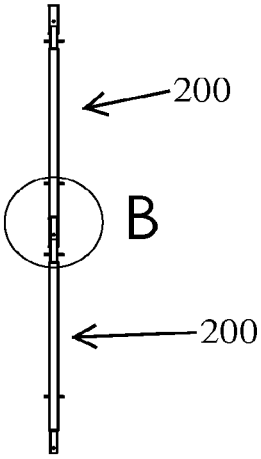
FIG. 23 is a perspective view of two connected high capacity vertical members.

These various diameters are shown in the sectional view of FIG. 24. As can be seen from this figure, the reinforcing sleeve 216 has a substantial overlap with the top tubular section 206 and extends significantly upwardly to provide a strong mechanical connection with a spigot that is received within this reinforcing sleeve. This avoids racking and other problems which can cause reduced capacity.

The vertical member 200 shown in FIGS. 20 through 25 did not include the locking collar 224 as shown in FIG. 19 and also described in detail in the earlier figures. This locking collar works in the manner described in my related copending US application Twist Lock Coupling Spigot, Ser. No. 12/260,835 filed Oct. 29, 2008 and incorporated herein by reference. This locking collar can cooperate with the bottom tubular section 208 that forms the spigot. This spigot includes locking projections provided at an upper point. The tubes can also include a series of ports to allow mechanical connection of the spigot to the reinforcing sleeve as shown in the drawings.

The vertical members as described overcome the off module problems associated with increasing the size of the vertical members and, therefore, the resulting modular scaffold system can be used to support heavier loads than other scaffolds systems currently on the market. This unique feature is achieved preferably by using larger vertical tubes of 60.3 mm diameter and reducing the diameter of these tubes at each end to 48.3 mm in diameter. This enables the same rosette type connection to be used and also allows the horizontal members to bear against the 48.3 mm portion of the leg tube, thus preserving and maintaining the predetermined horizontal spacing between the vertical members.

It is important to note the significance of using 60.3 mm diameter tube. There are commonly available tube couplings that allow 48.3 mm diameter tubes to be connected to 60.3 mm diameter tubes. So, if additional bracing tubes are required to be connected to the vertical members of the present invention, the necessary couplers will be readily and easily obtained. As can be appreciated variations in dimensions are possible however the description refers to many common systems.

While the reduction of the diameter of the vertical tubes is advantageous in order to maintain the correct horizontal spacing of them when used with modular horizontal members, the length of the reduced diameter must be minimized in order to avoid this portion of the leg being weakened and have an adverse effect upon the load bearing capacity of the whole vertical member. For this reason, a 60.3 mm diameter sleeve is located over the end of the reduced diameter portion of the vertical member. This sleeve is positioned such that it is as close to the connection point as possible and reduces the length of the 48.3 mm diameter portion to a minimum. This sleeve also serves as a very strong connection between each of the vertical tubes and thus maintains the higher load capacity. This connection differs from those used in regular modular scaffolding systems, which use a male type spigot tube which enters into the end of the vertical member above. Because the male spigot tube must be smaller in diameter and consequently weaker, it can have the tendency to reduce the load bearing capacity of the vertical members. In a shoring system, where high load capacity is required, any such loss in capacity would be undesirable.

When joining the high capacity vertical members end-to-end, the bottom portion of the tubular vertical members must fit into the connecting sleeve. In order for this to be possible, the bottom portion of the vertical member must also be reduced to 48.3 mm diameter to fit inside the sleeve tube. When inserted into the sleeve connector, the weaker smaller diameter of the vertical tube is compensated by the strength of the larger diameter of sleeve tube, which provides additional support and stiffness to the connection and the smaller diameter portion of the vertical scaffold member.

The connection sleeve and the bottom of the vertical members each have corresponding holes through which a pin, rivet, clevis pin or bolt can be passed in order to securely attached to the top and bottom vertical members together.

In the embodiment of FIG. 19, the sleeve tube has a self-locking feature that allows the vertical members to be joined end-to-end without the need for separate locking pins, clevis pins, rivets or bolts. This embodiment uses the locking collar and locking pins of my related U.S. application Ser. No. 12/260,835, Twist Lock Coupling Spigot, incorporated herein in its entirety by reference.

In addition to providing a means to maintain the predetermined spacing of the vertical members, the portions of the vertical tubes, which are reduced in diameter, also enable the same diameter adjustable screws to be used at the top and bottom of the present shoring system. The threaded part of the screw jacks, which are also used extensively for modular scaffold system, have an outside diameter of approximately 38 mm. Since the inside diameter of the reduced portion of the shoring vertical member is approximately 41.9 mm, the threaded portion of the screw jack will fit into the inside of the 48.3 mm diameter portions at the top and bottom of the vertical members with very little additional room. This fairly tight interface effectively restricts any sideways sway movement in the adjustable jacks and, therefore, maintains their verticality and load bearing capacity.

As a further advantage, it is possible to use the same base collar at the bottom of the shoring structure, as used for regular modular access scaffolds. This means that the same components can be used with the present system.

In addition to being compatible with individual horizontal members, the high capacity vertical members may also be used with modular scaffold double guardrail units. When used for access scaffolds, these double guardrail units provide a top rail and mid rail protection to working platforms. When used in conjunction with the high capacity vertical members, the guardrail units join the vertical members together horizontally and provide bracing to strengthen the vertical members and help the assembly to resist horizontal loads due to wind, concrete placing etc.

The bottom connections of the guardrail units utilize pins. These locate into holes in the rosettes of modular scaffold systems. In another embodiment of the present invention, the vertical members are fitted with a connection plate 224 with four holes to accept the bottom locating pins of the double guardrail units. Because these pins do not make contact with the outer wall of the vertical tube, the predetermined spacing of the vertical members is not affected by the 60.3 mm outside diameter of the vertical tube where these connections are located.

Although various preferred embodiments of the present invention have been described herein in detail, it will be appreciated by those skilled in the art, that variations may be made thereto without departing from the scope of the appended claims.

The embodiments of the invention in which an exclusive property or privilege is claimed are defined as follows:

1. A modular scaffolding system having a series of modular frames and a series of high load vertical members with each of said series of modular frames and said series of high load vertical members having securing rosettes vertically spaced to accommodate modular connection between said modular frames, between said high load vertical members and between said modular frames and said high load vertical members;

said series of modular frames having secured frame vertical members of predetermined lengths with said modular frames and said high load vertical members each being interchangeably connectable in an end to end manner using a spigot type connection with a female connector at one end and a cooperating spigot at an opposite end of each frame vertical member and each high load vertical member;

said frame vertical members being selectively horizontally connectable to other frame vertical members to maintain a predetermined distance between connected modular frames using said securing rosettes of said frame vertical members and releasable ledger members of predetermined modular lengths with each ledger member having ledger heads at opposite ends thereof;

said frame vertical members having a first rated load capacity and said high load vertical members each having a second rated load capacity higher than said first rated load capacity;

said frame vertical members each comprising an elongate tube of a first diameter with said securing rosettes secured on the exterior of the elongate tube at predetermined positions spaced in the length of said elongate tube with at least a top securing rosette adjacent one end of said elongate tube, a bottom securing rosette adjacent an opposite end of said elongate tube and at least one intermediate securing rosette located between said top and bottom securing rosettes;

said securing rosettes of said modular frames each being connectable to any one of said ledger heads of said releasable modular ledger members with said ledger heads engaging bearing surfaces of said elongate tube either side of the securing rosette;

each of said high load vertical members comprising a unitary one-piece elongate tube cooperating with said female connector at one end thereof and cooperating with said cooperating spigot at an opposite end thereof; and wherein said unitary one-piece elongate tube of each high load vertical member includes major segments of a second diameter greater than said first diameter with a minor segment of reduced diameter corresponding to said first diameter separating adjacent major segments, and wherein at least one said minor segment is located intermediate the length of the unitary one-piece elongate tube;

said securing rosettes of each high load vertical member being spaced apart in a length of the high load vertical member at positions to cooperate with said securing rosettes of said frame vertical members and including at least one intermediate securing rosette located intermediate the length of the high load vertical member;

said securing rosettes of said high load vertical members being located in said minor segments of reduced diameter such that ledger bearing surfaces either side of the securing rosette are located inwardly of said second diameter to maintain modular horizontal spacing using said releasable ledgers;

each unitary one-piece elongate tube of said high load vertical members above and below each securing rosette including a tube portion of a diameter corresponding to said first diameter with each tube portion providing sufficient space to accommodate and present bearing surfaces for any of said ledger heads at a position inwardly of said second diameter;

wherein said high load vertical members are interchangeable with said modular frames, and said high load vertical members are horizontally connectable to said modular frames using said releasable ledgers while maintaining modular spacing of said scaffold system.

2. A modular scaffolding system as claimed in claim 1 wherein a spacing between said securing rosettes of said high load vertical members and a spacing between rosettes of said frame vertical members is equal.

3. A modular scaffolding system as claimed in claim 1 wherein each high load vertical member as part of said spigot type connection includes an outer tubular reinforcing sleeve about one end of the high load vertical member and forms part of said female connector.

4. A modular scaffolding system as claimed in claim 1 wherein each unitary one-piece elongate tube of said high load vertical members at opposite ends thereof include segments of said reduced diameter and one of said ends of said reduced diameter includes an outer reinforcing sleeve that forms part of said female connector.

5. A modular scaffolding system as claimed in claim 1 wherein each high load vertical members includes a plurality of said minor segments and said minor segments are of a diameter equal to said first diameter.

6. A modular scaffolding system as claimed in claim 1 wherein said first diameter is approximately 48 mm and said second diameter is approximately 60 mm.

7. A modular scaffolding system claimed in claim 6 further comprising a coupling member that passes through a port in said female connector and a port in said spigot to maintain a connection of said female connector of one of said high load vertical members and a received spigot of a connected vertical member.

8. A modular scaffolding system as claimed in claim 7 wherein said coupling member is selected from the group consisting of pins, rivets, clevis pins or bolts.

9. A modular scaffolding system as claimed in claim 1 including a high load support tower defined by a number of said high load vertical members connected horizontally by ledger members and including high load vertical members connected end to end to define a multi-level high load support tower.

10. A modular scaffolding system as claimed in claim 1 wherein said securing rosettes of said modular frames and said high load vertical members all have an equal outer periphery and common securing ports.

11. A modular scaffolding system as claimed in claim 1 wherein said minor segments of reduced diameter include an outward step used to secure the securing rosette to said segment of reduced diameter.

12. A modular scaffolding system as claimed in claim 1 wherein said at least one intermediate securing rosette of each high load vertical members is a split part securing rosette welded to the exterior of the segment of reduced diameter to form a complete securing rosette.

* * * * *